US006788794B2

(12) United States Patent
Corsaro et al.

(10) Patent No.: US 6,788,794 B2
(45) Date of Patent: Sep. 7, 2004

(54) THIN, LIGHTWEIGHT ACOUSTIC ACTUATOR TILE

(75) Inventors: Robert Corsaro, St. Charles, MD (US); James Tressler, Alexandria, VA (US); Joseph Klunder, New Carrollton, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 121 days.

(21) Appl. No.: 10/263,296

(22) Filed: Oct. 1, 2002

(65) Prior Publication Data

US 2004/0062405 A1 Apr. 1, 2004

(51) Int. Cl.[7] ..... H04R 25/00
(52) U.S. Cl. ..... 381/152; 381/71.4; 381/71.8
(58) Field of Search ..... 381/152, 184, 381/190, 191, 396, 398, 71.1, 71.4, 71.7, 71.8, FOR 140, FOR 163; 181/207, 208

(56) References Cited

U.S. PATENT DOCUMENTS

| | | | | | |
|---|---|---|---|---|---|
| 5,802,195 | A | * | 9/1998 | Regan et al. | 381/190 |
| 6,215,884 | B1 | * | 4/2001 | Parrella et al. | 381/190 |
| 6,490,360 | B2 | * | 12/2002 | Corsaro | 381/182 |
| 6,674,219 | B1 | * | 1/2004 | Szilagyi et al. | 310/328 |
| 2001/0026625 | A1 | * | 10/2001 | Azima et al. | 381/152 |
| 2001/0033669 | A1 | * | 10/2001 | Bank et al. | 381/152 |

* cited by examiner

*Primary Examiner*—Curtis Kuntz
*Assistant Examiner*—Brian Ensey
(74) *Attorney, Agent, or Firm*—John J. Karasek; George A. Kap

(57) ABSTRACT

A thin, lightweight electroacoustic actuator device covering a large surface area providing a high piston-like output over the frequency range of from at least 30 to in excess of 500 Hz comprising a stiff, lightweight face plate; a backing structure disposed below the face plate; at least one driver structure disposed between the face plate and the backing structure; and flexible structure flexibly connecting the at least one driver to the face plate.

20 Claims, 4 Drawing Sheets

THIN, LIGHTWEIGHT ACOUSTIC ACTUATOR TILE

BACKGROUND OF THE INVENTION

1. Field of the Invention

This invention pertains to the field of acoustic actuators and the application of special interest therefor is the active noise control of interior spaces.

2. Description of the Related Art

The minimization or outright elimination of structural vibrations and structure-borne sound has numerous advantages. For instance, minimizing cabin noise in an aircraft or duct noise in a building leads to a much higher comfort level for the people inside. In addition, satellite payload launch noise damage mitigation is desirable in order to minimize damage to payload components.

Essentially, there are two means by which to control unwanted sound and vibration. The first method involves adding additional mass, stiffness, or damping to the structure. The first method techniques, all types of passive control, are best suited for applications where the frequency band of the disturbance is above 1 kHz. The second method, i.e., the active control method, is based upon destructive interference of the sound or vibration field. In active control, a sensor/actuator combination, some components of which are typically located on the surface of the vibrating structure, is used to detect and suppress the disturbance. The vibration signal picked up by the sensor is reconfigured and conditioned to drive the actuator in such a manner as to reduce the net effect of the disturbance. In one embodiment, for example, the actuator is driven such that its output field has the same magnitude but opposite phase as the disturbance.

Current state of the art in active vibration and acoustic control systems is that the sensor and electronic sub-systems are more technologically advanced than the actuator components. Control systems have benefitted from faster and cheaper microelectronics available from the computer industry. Likewise, a wide variety of sensors have been developed including optical fibers, piezopolymers, piezocomposites, and acoustic pressure sensors. Sensor selections can now be based on application specific needs. This means that typically, the weakest link in most active control systems is in actuator technology. Although actuator devices for underwater systems have been advanced, the use of such devices in air is difficult because of the impedance load mismatch between the device and the air medium. The specific acoustic impedance of a medium can be defined as density of the medium multiplied by speed of sound in that medium, and the impedance for water is 3700 times the impedance of air. Consequently, the displacements of the in-air actuators must be improved by orders of magnitude when compared to the displacements of in-water actuators.

In systems aiming to control sound penetration or reflections from a surface, a pressing need is for an actuator that exhibits a displacement at least as large as that associated with the noise source over an appreciable area. Additional considerations include thin geometry, low weight, high spatial uniformity, and smooth and well-behaved transfer functions. The actuator must also be physically rugged enough to withstand normal forces and hazardous exposures.

Many active control systems utilize either hydraulics or large, heavy electromagnetic force transducers as the actuator component. These technologies may often be constrained by packaging and weight limitations. In recent years, piezoelectric materials either in the form of piezopolymers, multilayer stacks, or in bender-type configurations have been studied as the actuator components in active control applications. Multilayer stacks are characterized as generating high force/low displacement whereas the flexors exhibit low force/high displacement capabilities.

Currently under development are techniques for the active noise quieting of interior spaces. The conceptual approach to this effort is to develop an acoustic blanket containing multi-unit arrays that may be mounted either on the structure boundaries or hung from the wall in the interior free space. One of the most difficult aspects of this concept is the actuator sub-system. This particular component is the key to the system in that large spatially uniform displacement over a large area and well-behaved acoustic output functions, preferably at low driving voltage, are required while maintaining low weight and a thin profile. A low driving voltage is safer and high voltage amplifiers and related components have higher weight and size. These two needs are difficult to obtain, as they are inconsistent with present technology capabilities.

OBJECTS AND BRIEF SUMMARY OF THE INVENTION

An object of this invention is an acoustic actuator which includes a plurality of drivers that produce a large displacement (total displacement) exceeding about 20 $\mu$m.

Another object of this invention is a thin and/or lightweight acoustic actuator that includes a plurality of drivers.

Another object of this invention is an acoustic actuator that is capable of covering a large surface area.

Another object of this invention is an actuator which can be operated with a low drive voltage from −300 to +300 Volts at frequency in the range of at least 30 to above 500 Hz.

Another object of this invention is a thin and a lightweight actuator that has large displacement exceeding about 20 $\mu$m at frequency of about 30–500 Hz.

Another object of this invention is an acoustic actuator with multiple drivers yielding a piston-like motion.

These and other objects of this invention can be attained by an actuator characterized by a stiff face plate, a backing structure spaced from the face plate and at least one driver disposed between the face plate and the backing structure driving the face plate in piston-like fashion, when actuated by driving voltage.

BRIEF DESCRIPTION OF THE DRAWINGS

A more complete appreciation of this invention will be readily obtained by reference to the following Detailed Description of the Invention and the accompanying drawings in which like numerals in different figures represent the same structures or elements, wherein:

FIG. 1(*b*) is a cross-sectional view of the commercially available bender driver and some associated actuator structure;

FIG. 1(*c*) is an enlarged view of a rubber strip which is flexible indirections (x) and (z) but is relatively rigid in direction (y);

DETAILED DESCRIPTION OF THE INVENTION

This invention pertains to an acoustic actuator device with a high acoustic output over the frequency range from about 30 to over 500 Hz driven by at least one, but preferably a plurality, driver secured between vertically spaced face plate and backing structure. The high acoustic output derives from the large, spatially uniform displacement generated over the surface of the actuator. The intended application is the active noise control quieting of interior spaces. In such an application, the device would be attached to the surface of interest and the top surface electrically driven so that it vibrates with the desired displacement amplitude and phase relative to the offending signals, in such a way that it acoustically mitigates the undesired noise. The thin, lightweight characteristics of the device make it particularly well suited for aerospace applications, such as for use on rocket payload fairings. Throughout the specification, and the claims that follow, it should be understood that terms such as "upper" and "lower", "above" and "below", and the like, are used as a convenience to distinguish various structures relative to each other. These terms are not intended to imply any orientation with respect to any external frame of reference.

Figure 1A:
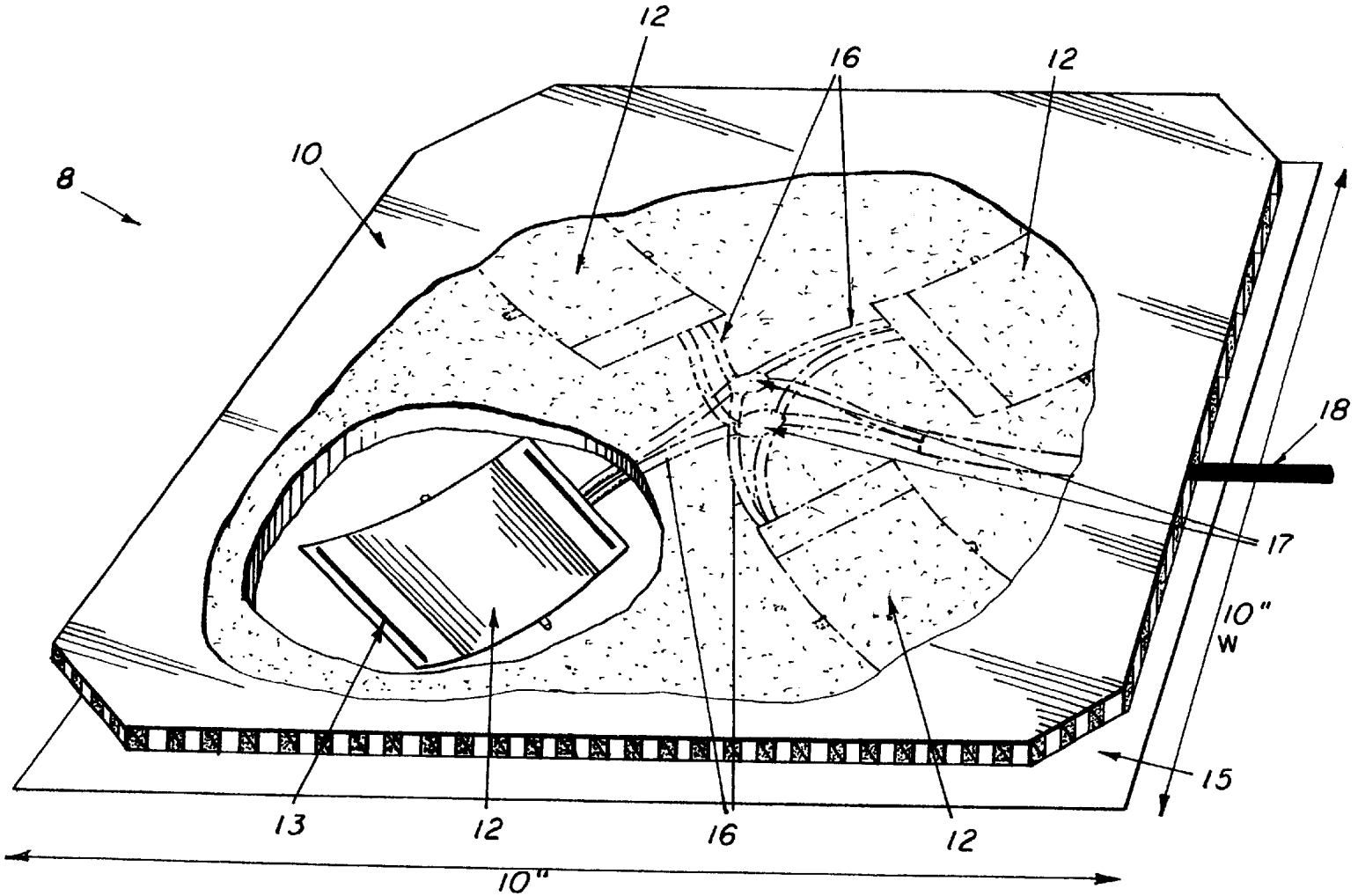
FIG. 1(*a*) is an isometric view of a generally square acoustic actuator showing four equally spaced bender drivers spaced between the face plate and the backing structure, with one driver being exposed, for the purpose of this illustration, by cutting out a portion of the face plate.
Figure 1B:
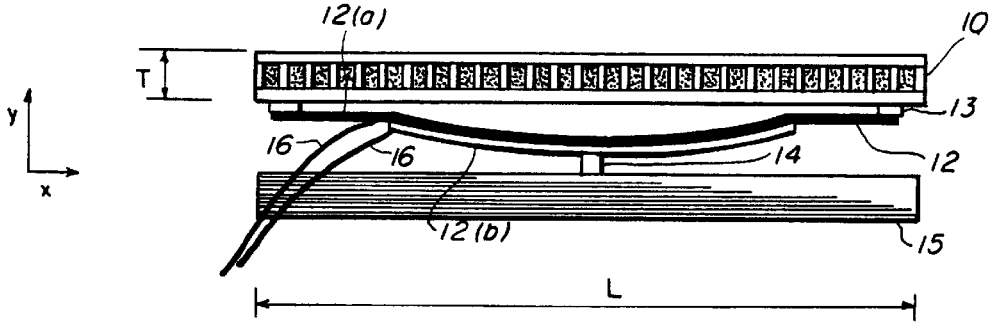
Figure 1C:
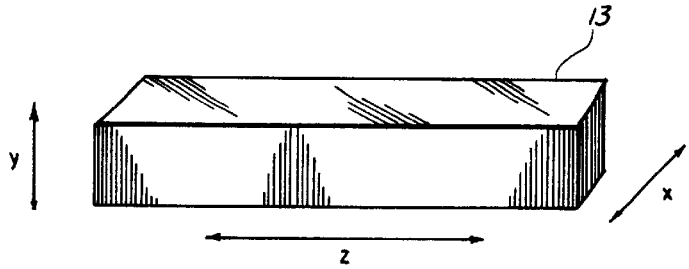

The preferred embodiment of the electroacoustic device, i.e., the acoustic actuator, is shown in FIG. 1(*a*) which is an isometric view of the device with a portion of the face plate cut out to show one of the bender drivers. The device 8 includes a flat, stiff, and lightweight face plate 10 with a backing structure 15 of about equal planar dimensions or larger to accommodate more than one face plate, spaced directly below face plate 10. Disposed between face plate 10 and backing structure 15 is one or more of bender drivers 12 which are secured to the face plate and the backing structure. The drivers are arranged in generally equally spaced relationship to each other and drive the face plate in a piston-like fashion in response to an electrical signal delivered to each driver by electrical leads 16 which emenate from common points 17, which receive the signal through electrical cable 18 from an electrical source, not shown.

The cut-out in FIG. 1(*a*) shows one of the four drivers exposed with driver 12 secured to face plate 10 by thin, narrow soft strips of rubber 13 adhering at edges of the driver. As shown in FIG. 1(*c*), strip 13 is flexible in direction (x) but is relatively rigid in direction (y). Flexibility/stiffness of strips 13 in direction (z) is not important. The strips allow adequate "give" at edges of the drivers to allow for greater displacement in the middle of each driver, as opposed to the condition where the driver edges are rigidly clamped. The "give" along the edges of the driver constitutes a spring-supported boundary condition which approximates the laterally-unconstrained simply-supported structure. By choosing a strip with a y-axis spring constant to be significantly stiffer than the spring constant of the bender element, shown in connection with FIG. 1(*b*), it is possible to achieve resonance frequency of the device that very closely approaches that of using just the bender.

FIG. 1(*b*) is a cross-sectional view through one driver of the device of FIG. 1(*a*) and shows some components and relationships thereof more clearly. As shown in FIG. 1(*b*), face plate 10 is a rigid, lightweight typically honeycomb structure that is disposed above backing structure 15. Offending noise and/or vibrations are typically situated below the backing structure and is projected through the device where it is minimized or eliminated. Disposed between face plate 10 and backing structure 15 is driver 12 composed of bender element 12(*a*) and driver element 12 (b) disposed and adhering to the driver element. Driver element 12(*b*) typically does not extend to the outside edges of bender element 12(*a*) but is centrally disposed on the underside of the bender element. The driver element is typically made of a piezoelectric material, such as PZT material [$Pb(Zn,Ti)O_3$], which can be made to expand or contract by application of voltage through electrical leads 16, assuming proper polling. One lead 16 is electrically connected to bender element 12(*a*) which is in electrical contact with the inner surface of driver element 12(*b*) while the other lead is connected to the outer surface of driver element 12(*b*). For contraction/expansion to take place, driver element 12(*b*) is poled through its thickness.

Bender element 12(*a*) is typically rectangular or square, although it can be of any other shape, as can face plate 10, driver element 12(*b*) and backing structure 15. Bender element 12(*a*) typically has a large concave radius of curvature facing up, as viewed in FIG. 1(*b*), with driver element 12(*b*) adhering to its underside. Outside edges of bender element 12(*a*) extend outwardly along face plate 10 where bender element 12(*a*) is secured to face plate 10 by means of rubbery strips 13 at opposite sides. The strips can be in the form of elongated strips or in the form of discontinuous elements or dots. The strips are secured to outer edges of bender element 12(*a*) and also to face plate 10. If the edges of the bender element are not attached to the face plate using these rubber strips, undesirable vibration modes are set in motion. Bender driver 12 is also secured to the backing structure 15 by means of strip 14, which can be similar or different from strips 13 but will typically have higher stiffness in the y direction. Lightweight strip 14 is secured to driver element 12(*b*) which, in turn, is secured to backing structure 15, as by means of a suitable adhesive. Strip 14 is typically bonded along the middle of the driver element. The purpose of strip 14 is to better control the width of the contact region between the driver element and the backing structure 15 and to reduce the transfer of lateral strains and torques. Location of strip 14 on driver element 12(*b*) is related to piston-like motion of the displacement and the ability to obtain maximum or optimum displacement.

When a positive voltage signal is applied to the bender driver mounted in a spring-supported edge condition, driver element 12(*b*) expands pushing on bender element 12(*a*) making it more concave and increasing its curvature. Since bender element 12(*a*) is secured to face plate 10 through strips 13, this has the effect of pushing at the contact points causing the face plate to move predominantly along the y axis, as viewed in FIG. 1(*b*), to produce a piston-like positive or vertical displacement. When alternating current applies a negative signal, the driver element contracts pulling on the bender element reducing its curvature to exert a force at strip points 13 causing the face plate to undergo a displacement that is down, as viewed in FIG. 1(*b*). Displacement or total displacement is the sum of the up and down motion of the face plate.

Drive voltage for the device of this invention is a low voltage in the approximate range from −300 to +300 Volts and displacement is on the positive and negative sides typically in the range of total displacement of 20–10,000

μm, more typically 100–4000 μm. High drive voltages greater than about 300 Volts are undesirable because amplifiers and other related devices at those levels are larger, more massive and the issue of safety becomes a consideration. Although optimum frequency range for the device is 30–200 Hz, useable range extends below 30 Hz and above 500 Hz.

Fundamental resonance frequency of the device is determined primarily by the mass of face plate 10 and the spring constant of the actuator. It is at resonance frequency that displacement is maximum. Below the resonance frequency, displacement produced is approximately independent of frequency, while above resonance frequency, the actuator is force-limited and the acceleration produced is approximately independent of frequency. It is necessary to use a rigid, lightweight face plate in order to obtain piston-like displacements. The required stiffness of the face plate depends on frequency of operation, its size and number of drivers and their placement. For the device demonstrated, stiffness of a suitable face plate should be in excess of 7 N-m bending stiffness, particularly in the approximate range of 15–200 N-m and its weight should be less than about 75 grams, preferably less than 50 grams per 10"×10"×0.2" (25.4 cm×25.4 cm×0.5 cm) panel.

The bender element 12(*a*) is typically metallic but can be of any material as long as it can deform and produce the desired displacement. The bender element can be made of stainless steel, aluminum, titanium, plastic or of any other suitable material. The bender element can also be represented by a second layer of driver material, activated with an opposing voltage forming a so-called bimorph. For the device demonstrated, driver 12 spring constant should be in excess of 1,000 N/m, particularly in the approximate range of 5,000–40,000 N/m.

Stiffness of suitable strips 13 should be such that it is relatively flexible in the horizontal (x) direction but should be rigid in the vertical (y) direction. More specifically, the combined spring constant of the two flexible strips in the horizontal direction should be less than 40,000 N/m, and particularly be in the range of 5000–20,000 N/m. In the vertical direction, the spring constant should be much greater than 6,000 N/m, and should be in the approximate range of 50,000–3000,000 N/m to ensure that the resonance of the cover plate supported by the strips has a frequency much greater than the device fundamental frequency. This additional resonance contributed by the mass of the cover plate and the compliance of the strips appears near 620 Hz in FIG. 2. Stiffness of the strips in the z direction is not considered to be important except to ensure good adhesion.

Stiffness of backing strip 14 is generally higher than that of strips 13 since it must support the additional mass of the actuator using only one strip. If it is chosen to be a rubber strip, similar to strips 13, it should have a spring constant in the vertical direction greater than 10 times that of the bender element 12(*a*), and preferably greater than 40 times, to avoid reducing the frequency of the driver resonance. An alternative is to use a hard-material and minimize the contact area. This can be implemented, for example, by using a thin, stiff rod glued using a flexible epoxy.

The backing structure is normally stiff but it need not be so.

In a specific embodiment of the device of FIG. 1(*a*), the indicated components had the following dimensions:

face plate 10—10"×0.2" (L×W×T)

backing structure 15—10"×10"×0.05"

bender element 12(*a*)—3"×2"×0.01" (flat)

driver element 12(*b*)—2"×2"×0.0175"

rubbery strips 13—2"×0.075"×0.060"

Support strips 14—1.0"×0.125" diameter rod

Face plate 10 was a stiff, lightweight carbon fiber honeycomb with bending stiffness of 20 N-m and weighing 41 grams. Backing structure 15 was an aluminum sheet. Bender element 12(*a*) was stainless steel with radius of curvature of 8.34" (21.2 cm). Driver 12, which includes elements 12(*a*) and 12(*b*), had a spring constant of 6000 N/m. Driver element 12(*b*) was of PZT material $Pb(Zr,Ti)O_3$. Rubbery strips 13 were commercially available rubber with a Shore A hardness of 10, a Young's modulus of 400 kPa; its combined vertical (y direction) spring constant was 45,000 N/m (for the two strips) and its shear spring constant (x direction) was about 11,600 N/m. Rod 14 was a piece of Bakelite hard plastic. For measurement purposes, a fiber optic displacement sensor was located above the top surface of the face plate 10 and a microphone was placed 10" (25.4 cm) in front of the face plate.

Figure 2:
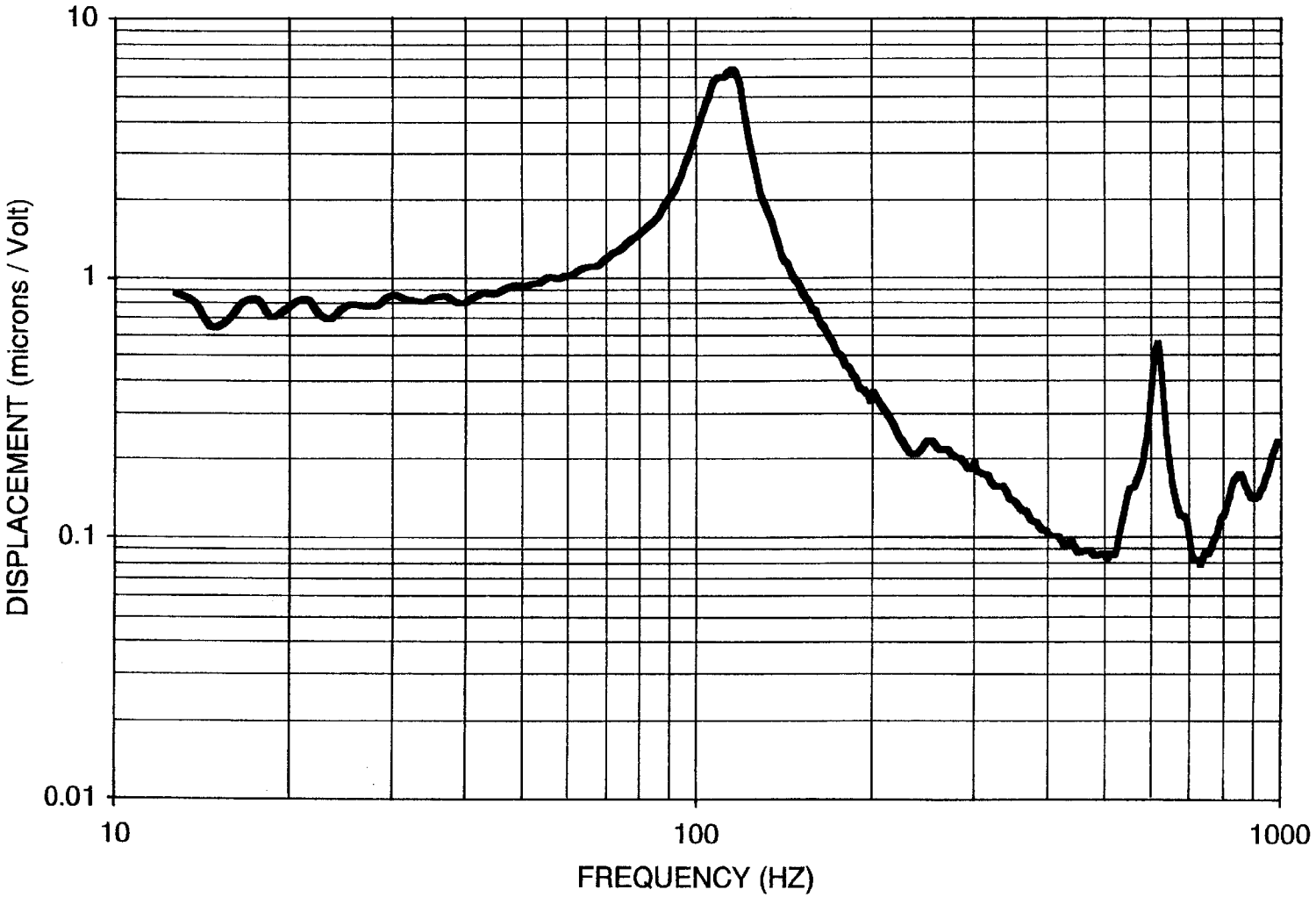
FIG. 2 is a graph of the relationship of surface displacement and frequency for the special embodiment of the acoustic actuator shown in FIG. 1(*a*)
Figure 3:
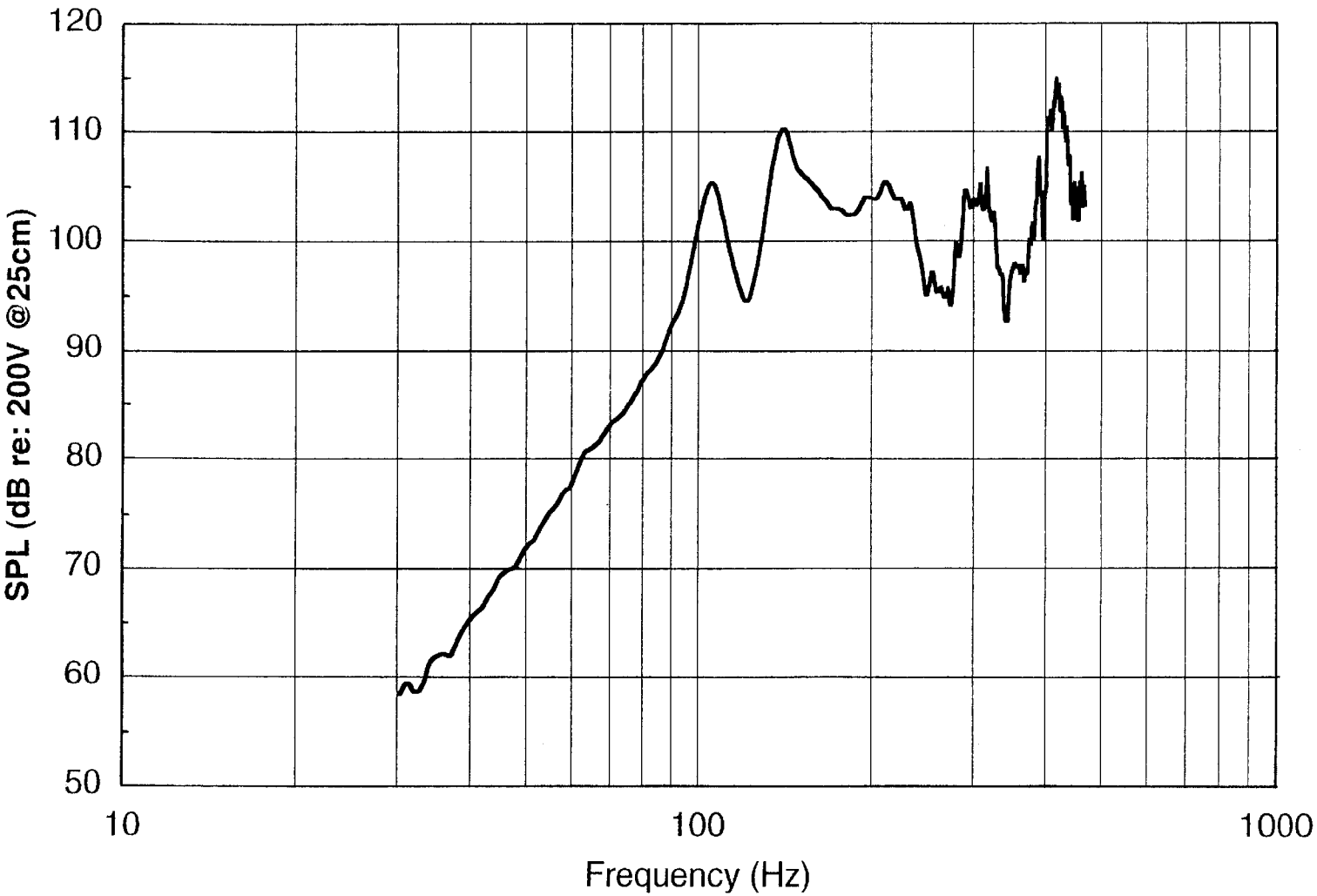
FIG. 3 is a graph showing the relationship of sound pressure level (SPL) and frequency for the special embodiment of the actuator shown in FIG. 1(*a*).

FIG. 2 shows the surface displacement of the acoustic-actuator tile of the specific embodiment shown in FIG. 1(*a*) measured at the center of the face plate. For these tests the backing was rigid. A surface displacement of at least 200 μm is achievable in the face plate for an applied voltage of less than 300 volts for frequencies in the range of 30–150 Hz. A surface map of the dynamic displacement at various frequencies, as measured by Laser Doppler Vibrometry, shows that only the expected plate vibration modes are present and that there is no unexpected complexity. More significantly, throughout this entire frequency regime, i.e., 30–150 Hz, the face plate continued to move predominantly in a piston-like fashion. The amplitude of the displacements associated with all plate modes was less than +/−20% and the sound pressure level generated at the frequencies of these modes was not significantly affected. This is confirmed by the measured sound pressure level (SPL) data that is presented in FIG. 3, As seen in the data of FIG. 3, at frequencies above the 120 Hz resonance of the device, the sound output is reasonably flat with increasing frequency. This is because above this resonance, the displacement of the device will be force-limited which tends to produce constant acceleration and the sound field is reasonably directive. Below this resonance of the device, the output of the device is displacement-limited. This is confirmed in FIG. 2 and introduces a decreased sound output with decreasing frequency. Additionally, in this frequency region, the size of the device also becomes smaller than the wavelength of sound. Since the microphone is then located in the so-called acoustic farfield region, there is increased energy spreading as frequency is reduced. The combined effects of displacement-limiting and spreading cause the measured SPL below resonance to decrease significantly but uniformly with decreasing frequency.

Two important notes should be made regarding this low-frequency performance. First, the levels produced, although lower than those produced above resonance, are still substantial. Second, if an array of such devices is used as in the intended applications, the reduction due to spreading will be essentially eliminated and the SPL levels below resonance will be predictable and significantly increased. Theoretically, for a large array of devices the slope of the line below resonance will be about half that shown in FIG. 3.

The unique feature of this invention, and that of the specific embodiment device shown in FIG. 1(*a*), is the high acoustic output and the associated uniform piston-like displacement profile that is achieved in a thin, lightweight, large surface area package at modest applied voltage levels.

The total thickness of the specific embodiment of the device was less than 13.7 mm and its mass was about 107 grams. The thin profile of the device can free up space in the interior of an aircraft and its low weight can permit larger rocket payloads, for instance. In addition, the overall structure of the device is mechanically rigid compared to the much more compliant typical prior art light weight and low frequency acoustic sources, such as loud speakers. Furthermore, the device design can be engineered for optimum output over a specific frequency range, allowing for more precise control of the deleterious noise/vibrations radiating from a particular space. For instance, by changing geometry of driver 12, it is possible to shift the resonance to the desired frequency.

While presently preferred embodiments have been shown of the novel acoustic actuator device, and of the several modifications discussed, persons skilled in this art will readily appreciate that various additional changes and modifications may be made without departing from the spirit of the invention as defined and differentiated by the appended claims.

What is claimed is:

1. A thin, lightweight device for producing high acoustic output at low frequencies that is piston-like over a large surface area comprising a stiff, non-resonant lightweight face plate; a backing structure disposed below said face plate; at least one driver structure disposed between said face plate and said backing structure; and flexible structure flexibly connecting said at least one driver to said face plate.

2. The device of claim 1 wherein said flexible structure includes driver flexible strips secured to said driver structure at edges thereof and also secured to said face plate, and wherein there are at least two driver structures, said device also including a backing flexible strip secured to said driver structure and said backing structure.

3. The device of claim 1 wherein low frequencies are in the range of 30–500 Hz and said flexible structure includes driver flexible strips secured to said driver structure at edges thereof and also secured to said face plate, and wherein there are at least two driver structures, said device also including a backing flexible strip secured to said driver structure and said backing structure.

4. The device of claim 3 wherein said face plate has bending stiffness of at least 7 N-m and its weight is less than about 75 grams per a 10"×10"×0.2" panel; said backing structure is a stiff, lightweight structure; said bender element has spring constant in excess of 1,000 N/m; said driver element is a layer of PZT material disposed centrally on the underside of said bender element; and said driver and said backing strips are narrow, soft strips of rubber.

5. The device of claim 4 wherein said driver and said backing strips are flexible in the horizontal direction and are rigid in the vertical direction, viewed as shown in FIG. 1(*b*); wherein said driver strips have combined spring constant in the horizontal direction of less than 40,000 N/m and in the vertical direction their combined spring constant is much greater than 6,000 N/m; and wherein said backing strip spring constant in the vertical direction is greater than 10 times that of said bender element.

6. The device of claim 5 having total displacement of 20–10,000 $\mu$m.

7. The device of claim 5 having total displacement of 100–4000 $\mu$m over the frequency range of 30–200 Hz for drive voltage of −300 to +300 Volts.

8. The device of claim 5 wherein bending stiffness of said face plate is 15–200 N-m and its weight is less than 50 grams per 10"×10" panel; wherein spring constant of said bender element is 5,000–40,000 N/m; wherein said driver strips are made from flexible material and their combined spring constant in the horizontal direction is 5000–20,000 N/m and in the vertical direction their combined spring constant is 50,000–300,000 N/m; and wherein said backing strip spring constant in the vertical direction is greater than 40 times that of said bender element.

9. The device of claim 8 wherein spring constant of said driver strips is stiffer than spring constant of said bender element.

10. The device of claim 8 wherein said device is part of a multi-unit array wherein a plurality of said devices are connected to each other to form said array.

11. A thin, lightweight device for noise control applications for producing high acoustic output at low frequencies that is piston-like over a large surface area comprising a stiff, non-resonant lightweight face plate; a backing structure disposed below said face plate; at least two driver structures disposed between said face plate and said backing structure; and flexible structure flexibly connecting said at least two drivers to said face plate.

12. The device of claim 11 wherein said flexible structure includes driver flexible strips secured to said driver structure at edges thereof and also secured to said face plate, said device also including a backing flexible strip secured to said driver structure and said backing structure.

13. The device of claim 12 wherein low frequencies are in the range of 30–500 Hz and each of said driver structures comprises a bender element and a driver element disposed underside of said bender element and adhering thereto, said driver element having the ability to expand/contract on application of an electrical signal, and wherein said drivers are generally equally spaced from each other.

14. The device of claim 13 wherein said face plate has bending stiffness of at least 7 N-m and its weight is less than about 75 grams per a 10"×10" panel; said backing structure is a stiff, lightweight structure; said bender element has spring constant in excess of 1,000 N/m and is concave; said driver element is a layer of PZT material disposed centrally on the underside of said bender element; and said driver and said backing strips are narrow, soft strips of rubber.

15. The device of claim 14 wherein said driver and said backing strips are flexible in the horizontal and longitudinal directions and are rigid in the vertical direction, viewed as shown in FIG. 1(*b*).

16. The device of claim 15 having total displacement of 20–10,000 $\mu$m.

17. The device of claim 15 having total displacement of 100–4000 $\mu$m over the frequency range of 30–200 Hz for drive voltage of −300 to +300 volts.

18. The device of claim 15 wherein bending stiffness of said face plate is 15–200 N-m and its weight is less than 50 grams per 10×10" panel; wherein spring constant of said bender element is 5,000–40,000 N/m; wherein said driver strips are made from flexible material and their combined spring constant in the horizontal direction is 5000–20,000 N/m and in the vertical direction their combined spring constant is 50,000–300,000 N/m; and wherein said backing strip spring constant in the vertical direction is greater than 40 times that of said bender element.

19. The device of claim 18 wherein spring constant of said driver strips is stiffer than spring constant of said bender element.

20. The device of claim 18 wherein said device is part of an acoustic blanket wherein a plurality of said devices are connected to each other to form said blanket.

* * * * *